US006606775B1

(12) United States Patent
Seyfert

(10) Patent No.: US 6,606,775 B1
(45) Date of Patent: Aug. 19, 2003

(54) PROCESS OF DETACHING AN AUTOMOTIVE CONTROL ARM

(76) Inventor: Kurt A. Seyfert, P.O. Box 1941, Eagle River, WI (US) 54521

( * ) Notice: Subject to any disclaimer, the term of this patent is extended or adjusted under 35 U.S.C. 154(b) by 0 days.

(21) Appl. No.: 09/850,312

(22) Filed: May 7, 2001

Related U.S. Application Data

(62) Division of application No. 09/568,191, filed on May 9, 2000, now abandoned.

(51) Int. Cl.[7] ..... B66F 3/00

(52) U.S. Cl. ..... 29/426.5; 29/267; 254/129; 254/131

(58) Field of Search ..... 254/30, 129, 130, 254/131; 294/17; 29/267, 426.5

(56) References Cited

U.S. PATENT DOCUMENTS 2,698,161 A * 12/1954 Kirby ..... 254/130
3,612,485 A * 10/1971 McAfee et al. ..... 254/130
4,250,769 A * 2/1981 Herring ..... 74/525
5,360,199 A * 11/1994 Speier ..... 254/129
5,382,131 A * 1/1995 Werthmann ..... 414/684.3
5,604,946 A * 2/1997 Stenerson ..... 7/117
5,713,559 A * 2/1998 McClarin et al. ..... 254/124
5,769,395 A * 6/1998 Patti ..... 254/129
5,938,177 A * 8/1999 Fonda ..... 254/25
6,375,162 B1 * 4/2002 Johnson ..... 254/131

* cited by examiner

*Primary Examiner*—Robert C. Watson
(74) *Attorney, Agent, or Firm*—Patterson, Thuente, Skaar & Christensen, P.A.

(57) ABSTRACT

A leveraging tool for disconnecting a control arm from the remainder of an automotive front wheel drive suspension system. The leveraging tool includes angularly disposed first and second portions, a pivot point being located therebetween. A chain, cable, or hook member attaches the second portion to the control arm. The control arm is detached when an input force is applied to the first portion.

6 Claims, 3 Drawing Sheets

PROCESS OF DETACHING AN AUTOMOTIVE CONTROL ARM

This is a Division of, and hereby incorporates by reference, application Ser. No. 09/568,191, filed May 9, 2000 now abandoned.

BACKGROUND OF THE INVENTION

1. Field of the Invention

This invention relates to automotive repair tools and, in particular, this invention relates to a tool separating components of automotive suspension systems.

2. Background of the Invention

When technicians are repairing automobiles, they frequently encounter difficulty when disconnecting suspension parts. While many of these suspension parts are connected using nuts, bolts, bearings and the like, they are exposed to dust, moisture, and other corrosive compounds during use. Consequently, disconnecting these suspension components can be difficult, hazardous, and often causes collateral damage to other automotive components as well. For example, when the lower control arm is being detached from a steering knuckle, a pry bar is frequently inserted between the control arm and the frame or transaxle floor pan. When force is then exerted on the pry bar, the transaxle floor pan may be dented or otherwise damaged. Moreover, other components may be similarly damaged if used as fulcrum points as well. Furthermore, the technicians frequently must apply the pry bar at mechanically disadvantageous angles and lengths due to the outlay of the suspension and surrounding components.

There is then a need for an implement to enable a technician to safely and efficiently detach automotive lower control arms.

SUMMARY OF THE INVENTION

This invention substantially meets the aforementioned need by providing a leveraging tool, the leveraging tool including a leveraging member, a fulcrum point, and a securing element. The leveraging member may be configured to be grasped by a user. The fulcrum point is disposed on or proximate the leveraging member. The securing element is attachable to the leveraging member and is configured to apply an output force to an automotive part such as a lower control arm. The output force is applied in response to an input force exerted on the leveraging member when the fulcrum is positioned against a pivoting structure on the automobile.

One feature of the present leveraging tool is that automotive suspension parts can be detached more easily and with greater relative safety.

Another feature of the present leveraging tool is that automotive suspension parts can be detached without damaging other adjacent structures.

These and other objects, features, and advantages of this invention will become apparent from the description which follows, when considered in view of the accompanying drawings.

DETAILED DESCRIPTION OF THE PREFERRED EMBODIMENTS

Figure 1:
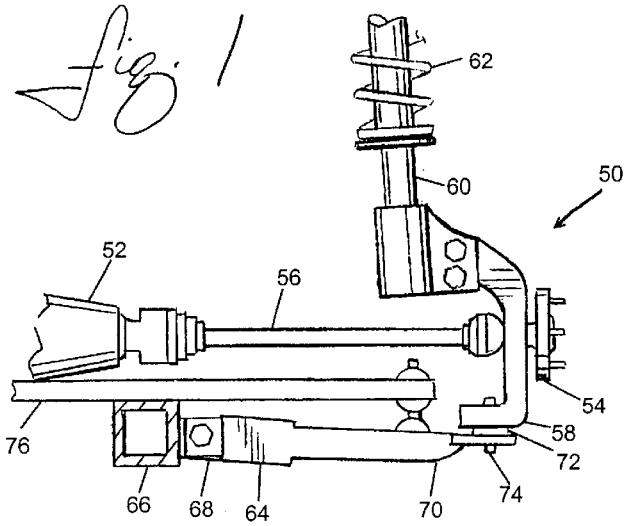
FIG. 1 is a fragmentary front view of a typical front wheel drive automobile suspension.
Figure 2:
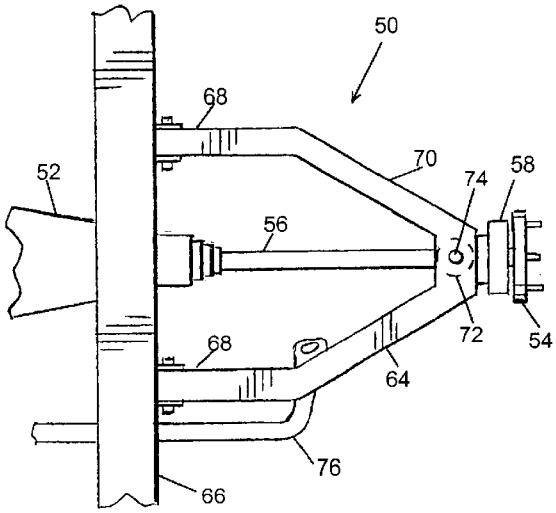
FIG. 2 is a fragmentary bottom view of the front wheel drive automotive suspension of FIG. 1.

Referring FIGS. 1 and 2, a typical front suspension and drive train is depicted for a front wheel drive vehicle generally at 50. Rotary power is transmitted from a transaxle 52 to a wheel bearing and hub assembly 54 via a CV-axle 56. The wheel bearing and hub assembly 54 is rotatably mounted in a steering knuckle 58. A strut 60 is attached to the steering knuckle 58. A coil spring 62 is disposed about a portion of the strut 60 to support and stabilize a portion of the vehicle. A lower control arm 64 is pivotally attached to a frame member 66 at a pair of control arm first ends 68. A control arm second end 70 is attached to the steering knuckle 58 by ball joint 72 and held in place with a fastener 74. A sway bar 76 is attached to the lower control arm 64 proximate its second end 70 by a bushing 78.

Figure 3:
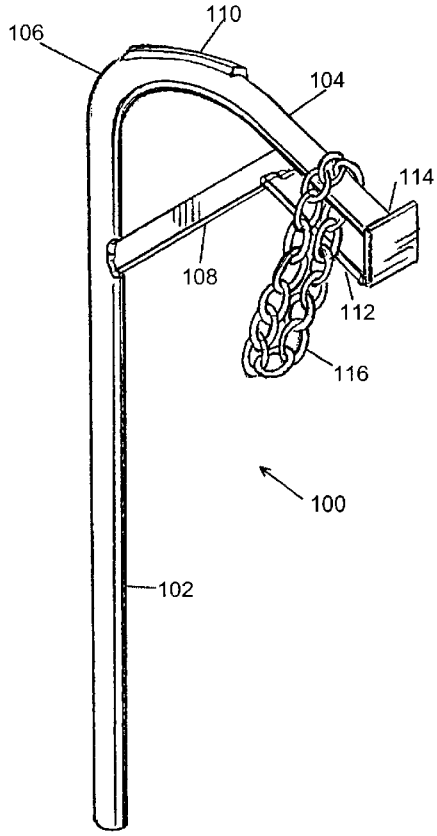
FIG. 3 is a perspective view of a first embodiment of the present leveraging tool.

Referring to FIG. 3, a first embodiment of the present detaching/leveraging tool is depicted generally at 100. This embodiment of the present invention is formed from steel tubing and includes respective first and second portions 102 and 104, which are generally separated by a bend 106. A brace 108 may extend between the first and second portions 102 and 104 to provide rigidity. A pivot pad 110 may be present on an upper side of the second portion 104 proximate the bend 106. Another bend is formed in a member 112. One end of the member 112 is welded to the leveraging tool proximate a first end 114. A second end of the member 112 is welded to the brace 108. A recurring element, such as chain (or cable) 116, is disposed between the member 112 and the underside of the leveraging tool 100. The chain 116 may include a hook or another device or combination (e.g., nut and bolt) to fasten the chain around both the leveraging tool second portion 104 and an automotive component such as a control arm. In this embodiment, the leveraging tool 100 is made from 1.25" diameter steel tubing with a thickness of 0.125". The pivot pad 110 is made from 0.125" thick steel plate and is about 4"×4" in dimension. In some embodiments, a high tack or rubberized substance may overlay the pivot pad 110 to reduce slippage during use. The pivot pad 110 is disposed over a position on the leveraging tool 100 which is a pivot or fulcrum point during use. In this embodiment of the present leveraging tool, the first portion 102 is about 4' in length and the second portion 104 is about 2' in length. Also in this embodiment of the present leveraging tool, the second portion 104 is angled about 80° from the first portion 102. However, the second portion 104 may be angled about 68°, between about 75° and 85°, between about 70° and 90°, between about 90° and 95°, or between about 85° and 100° from the first portion 102 in other embodiments. In some embodiments, the first portion 102 may include telescoping sections 118 and 120 and tightener coupling 122. Telescoping section 118 telescopes inside section 120 in this example, although obviously section 120 could telescope inside section 118 as well. The coupling 122 threads onto section 120, fixes the sections at a desired length when tightened, and allows the sections to be adjusted to a desired length when loosened. Rather than coupling 120, other length adjusting mechanisms known to the art may be used, e.g., a pin or bolt fitting into a series of aligned holes in the sections 118 and 120. One of the sections 118 and 120 may be solid if a strengthened embodiment is desired.

This and other embodiments of this invention may be made from solid or hollow (e.g., tubular) metal alloys known to the art such as steel, cast iron, and aluminum.

Figure 4:
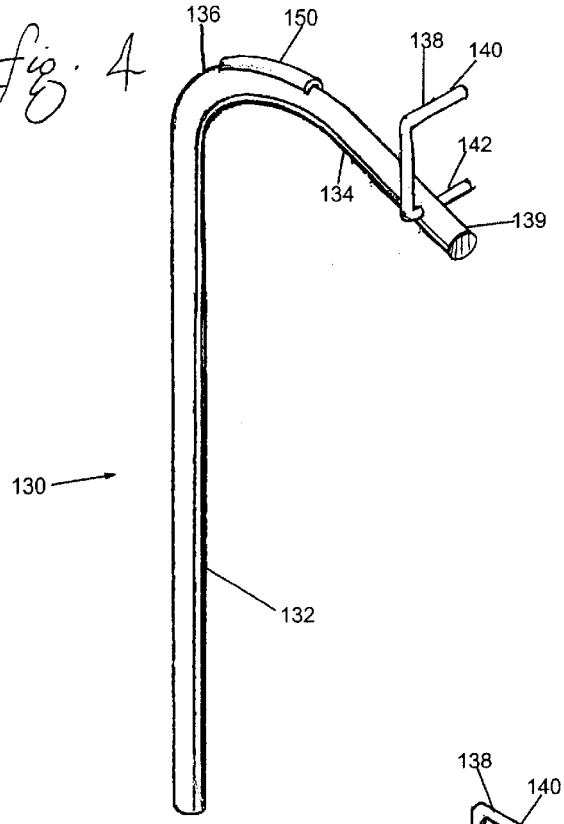
FIG. 4 is a perspective view of a second embodiment of the present leveraging tool.
Figure 5:
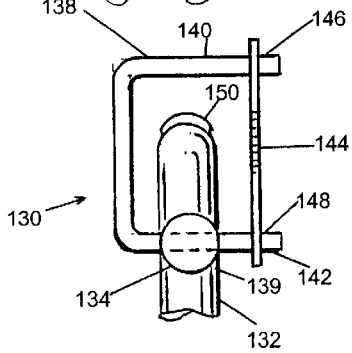
FIG. 5 is an end view of the leveraging tool of FIG. 4.
Figure 6:
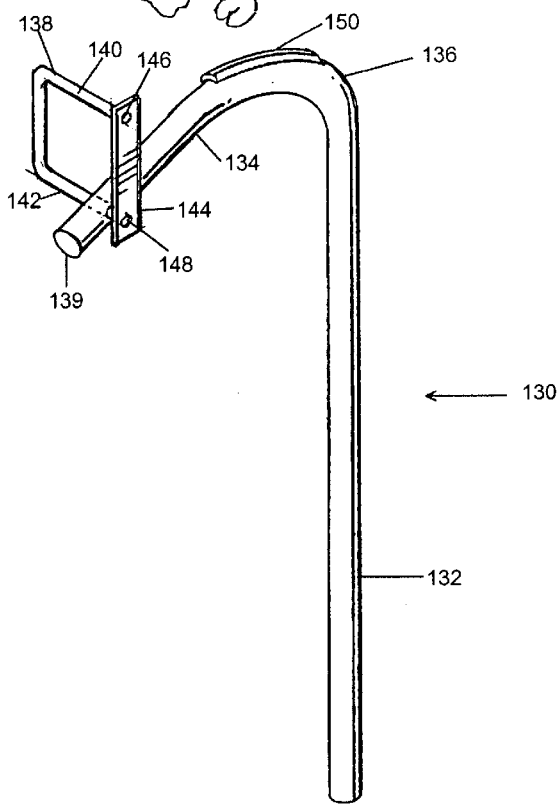
FIG. 6 is another perspective view of the leveraging tool of FIG. 4.

FIGS. 4–6 depict a second embodiment of the present leveraging tool generally at 130. The leveraging tool 130 includes a first portion 132 and a second portion 134 defined by a bend 136. The second portion 134 may angle from the first portion 132 as explained above with respect to leveraging tool 100. The first and second portions 132 and 134 may be formed from solid steel in this embodiment. The solid steel from which the leveraging tool 130 is formed may be 1" or 1¼" in diameter. Also in this embodiment, a securing element, such as square cornered C-hook 138 member, is attached to the second portion 104 proximate the second portion end 139. The C-hook 138 includes arms 140 and 142. The arm 142 extends generally diametrically through holes formed in the second portion 134. A plate 144, with holes 146 and 148, may be provided to provide rigidity to the C-hook 138. In this embodiment, the arm 140 may be disposed in the hole 146 and the arm 142 may be disposed in the hole 148 during use. The C-hook may be made from ½" diameter steel. The arms 140 and 142 may be about 6" in length and may be spaced apart by about 6". The first and second portions 132 and 134 may generally be about the same lengths as the first and second portions 102 and 104 of the leveraging tool 100. A pad 150 is welded, or otherwise fixed, to an upper surface of the second portion 134 at a pivot or fulcrum point thereof.

Figure 7:
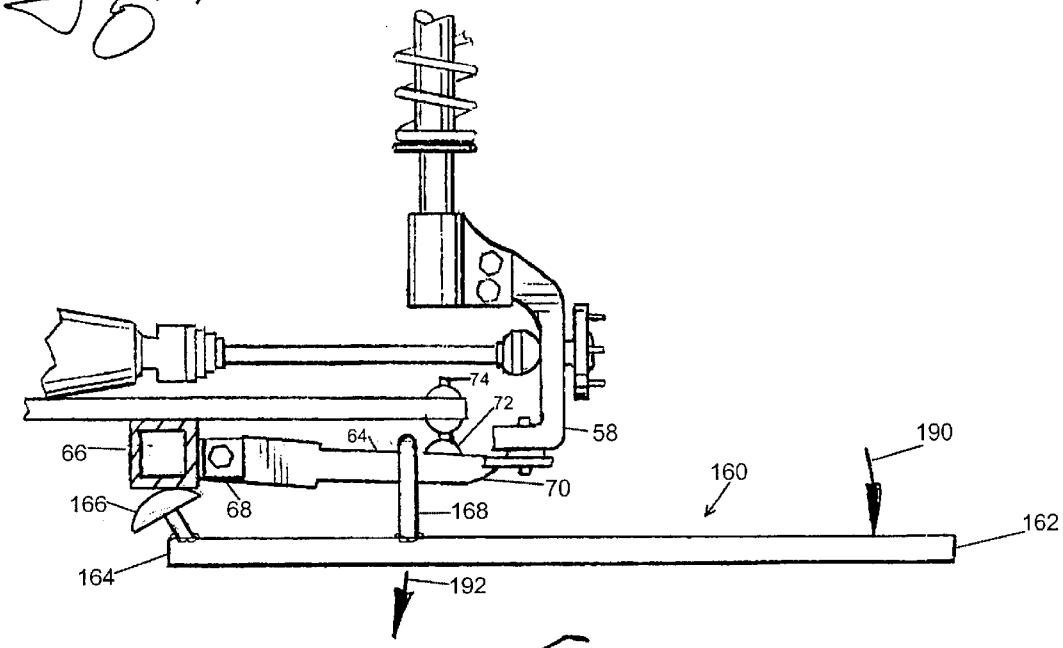
FIG. 7 is a front view of a third embodiment of the present leveraging tool.

FIG. 7 shows a third embodiment of the present leveraging tool 160. The leveraging tool 160 includes respective first and second ends 162 and 164. A pad 166 is fixed proximate the first end. A hook 168 extends from the leveraging tool 160 at a distance of between about 2' and 3' from the second end 164 in one embodiment. The hook 168 may be fixed or may be configured to slid along the leveraging tool to a desired position. Of course, a chain or cable, as described above, may be used in place of the hook 168.

Figure 8:
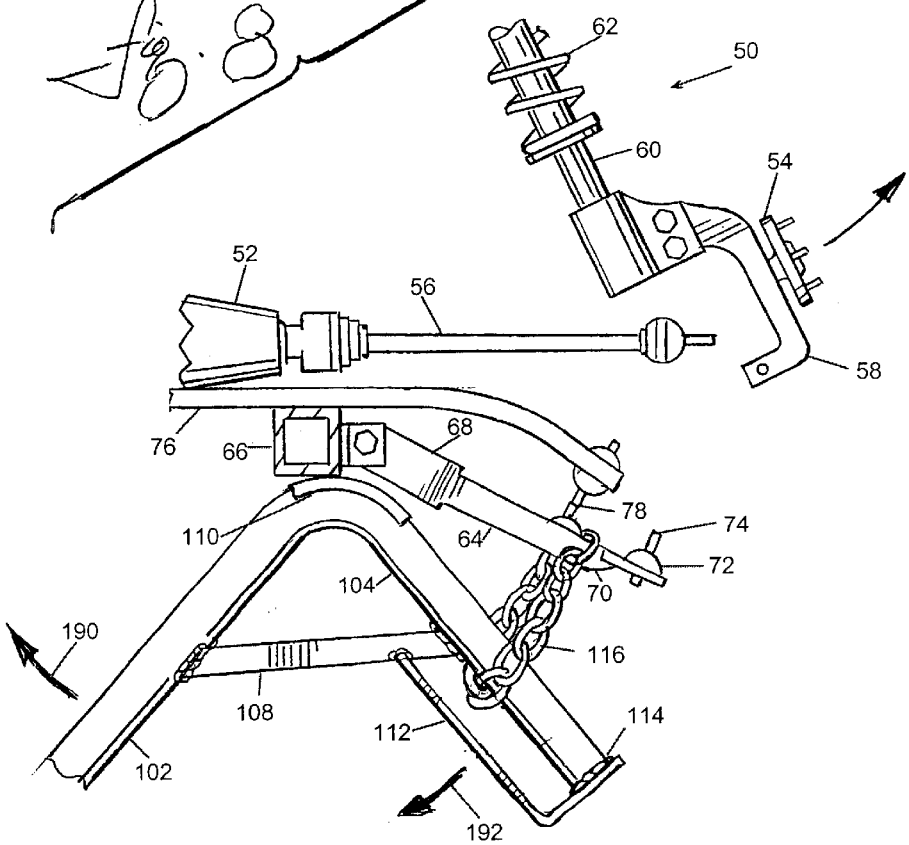
FIG. 8 is a front view of the leveraging tool of FIG. 3 being used to detach the lower control arm depicted in FIGS. 1 and 2.

FIG. 8 depicts how the embodiments described in FIGS. 3–6 may be used in automotive repair, e.g., separating the control arm 64 and ball joint 72 from the steering knuckle 58. The chain 116 is fastened about a desired place on the control arm and positioned such that the pivot pad 110 can contact the frame member 66, or another suitable pivot site such as a portion of the control arm itself. The first portion 102 is grasped by the user, the pivot pad 110 (or fulcrum point) is positioned against the frame member 66. The user then grasps the first portion 102 and exerts an input force generally in the direction of arrow 190. The input force is leveraged by the present tool to produce an output force generally in the direction of arrow 192. The sway bar 76 is still attached to the control arm 64 in this example. Therefore, the control arm must be biased away from the steering knuckle by the sway bar as depicted. Obviously, differing amounts of input force must be exerted depending upon the particular model of control bar, as well as other factors such as the extent of corrosion and rust present proximate the ball joint. Nonetheless, the control arm and ball joint are separated from the steering knuckle to enable subsequent repairs.

FIG. 7 depicts the embodiment shown therein detaching the control arm and ball joint from the knuckle. When using this embodiment, the pad 166 is positioned against the frame member 66 or other desired structure and the hook 168 is hooked around a desired position on the control bar. In some embodiments, the distance between the hook and second end 164 may be adjusted. The input force is exerted generally in the direction of arrow 190 to result in an output force generally in the direction of arrow 192. The input force is exerted until the control arm and ball joint are freed from the steering knuckle. The embodiment depicted in FIG. 7 may be especially useful when the automobile being repaired is not be positioned on a hoist.

Because numerous modifications of this invention may be made without departing from the spirit thereof, the scope of the invention is not to be limited to the embodiments illustrated and described. Rather the scope of the invention is to be determined by the appended claims and their equivalents.

What is claimed is:

1. A process of detaching an automotive control arm, comprising:

providing a leveraging tool, the leveraging tool comprising a leveraging member, the leveraging member comprising first and second portions separated by a bend, the first portion configured to be grasped, a fulcrum point disposed on the leveraging member proximate the bend, and a securing element attached proximate the second portion and configured to apply an output force to an automotive part held by the securing element as an input force is applied to the leveraging member first portion when the fulcrum is positioned against a pivoting structure;

securing the securing element about the control arm;

positioning the fulcrum point against an automotive structure; and applying an input force to the leveraging tool such that an output force detaches the control arm.

2. The process of claim 1, in which the securing element includes a chain and in which securing the securing element about the control arm includes securing the chain about the control arm and the leveraging member second portion.

3. The process of claim 1, in which positioning the fulcrum against an automotive structure includes positioning the fulcrum against an automotive frame.

4. The process of claim 1, the leveraging tool further including a pad disposed proximate the fulcrum point and in which positioning the fulcrum point against an automotive structure includes contacting the pad and the automotive structure.

5. The process of claim 1, in which the securing element includes a C-hook and in which securing the securing element about the control arm includes disposing a portion of the control arm within the C-hook.

6. The process of claim 5, in which the securing element further includes a brace with holes, in which the C-hook includes first and second arms disposable in the brace holes, and in which positioning the biasing element about the control arm includes disposing the C-hook first and second arms in the brace holes.

* * * * *